US007396263B2

(12) United States Patent
Chen et al.

(10) Patent No.: US 7,396,263 B2
(45) Date of Patent: Jul. 8, 2008

(54) ELECTRICAL CONNECTOR

(75) Inventors: De-Jin Chen, ShenZhen (CN); Wei Yuan, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/901,365

(22) Filed: Sep. 17, 2007

(65) Prior Publication Data

US 2008/0070451 A1 Mar. 20, 2008

(30) Foreign Application Priority Data

Sep. 18, 2006 (TW) ..... 95216574 U

(51) Int. Cl.
*H01R 13/40* (2006.01)

(52) U.S. Cl. ..... 439/733.1; 439/862

(58) Field of Classification Search ..... 439/733.1, 439/862, 74
See application file for complete search history.

(56) References Cited

U.S. PATENT DOCUMENTS

| | | | | | |
|---|---|---|---|---|---|
| 4,232,923 | A | * | 11/1980 | Otsuki et al. | 439/65 |
| 5,700,151 | A | * | 12/1997 | Korsunsky et al. | 439/74 |
| 5,975,914 | A | * | 11/1999 | Uchida | 439/66 |
| 6,039,601 | A | * | 3/2000 | Kraiczyk et al. | 439/500 |
| 2001/0014559 | A1 | * | 8/2001 | Akimoto et al. | 439/736 |

* cited by examiner

*Primary Examiner*—Tho D Ta
(74) *Attorney, Agent, or Firm*—Wei Te Chung

(57) ABSTRACT

An electrical connector comprises a dielectric housing comprising a base portion which comprising a plurality of contact passages, a plurality of conductive contacts retained in said contact passage, wherein a plurality of locating poles extending from the base portion, an end of said contact hanging on said locating pole. With the support of said locating pole said contact can resist strong strength of compression and prevent deformation.

15 Claims, 5 Drawing Sheets

ELECTRICAL CONNECTOR

BACKGROUND OF THE INVENTION

1. Field of the Invention

This invention generally relates to the art of electrical connectors.

2. Description of Related Art

Conventionally, an electrical connector for mounting on the printed circuit board comprises a housing which retains a plurality of electrical contacts. Each one of the contacts comprises one end extending outside of the housing for electrically connecting with the printed circuit board, and another end for electrically connecting with the contact of a complementary mating electronic device. Generally, the contact will be deformed easily when engaging with the complementary mating electronic device. Specially, the contacts will interference each other under serious compression of the complementary mating electronic device.

SUMMARY OF THE INVENTION

An object of the invention, therefore, is to provide an electrical connector the resilient contact portion of the contacts of which will not be deformed when the electrical connector engages with a complementary mating connector.

In the exemplary embodiment of the invention, the connector includes a dielectric housing having a plurality of conductive contacts retained therein. The dielectric housing comprises a base portion which comprises a plurality of contact passages and a plurality of locating poles. Each of said contacts is respectively retained in said passage and hanged on said locating pole.

With the support of said locating pole said contact can resist strong strength of compression and prevent deformation.

DETAILED DESCRIPTION OF THE INVENTION

Reference will now be made in detail to the preferred embodiment of the present invention.

Figure 1:
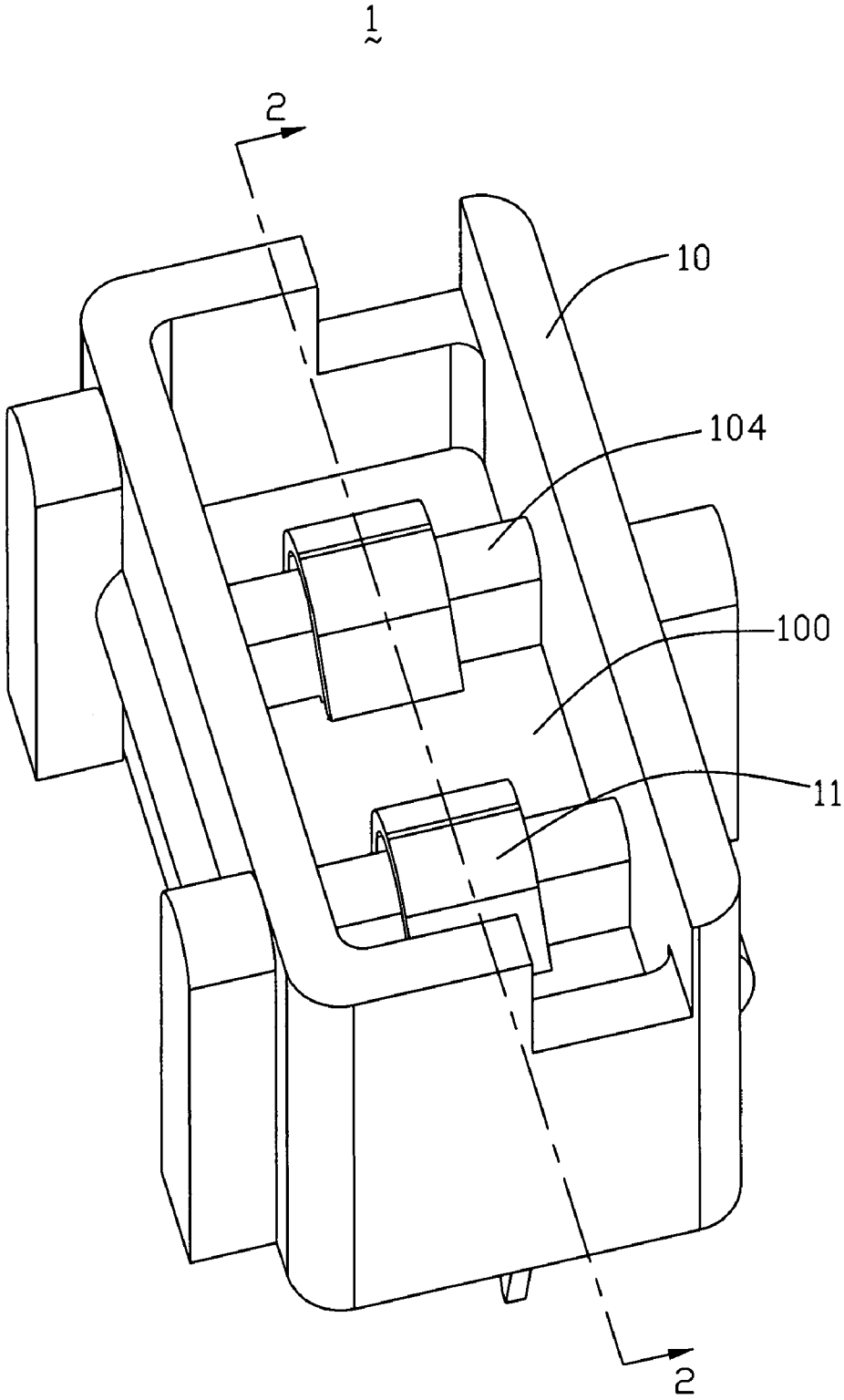
FIG. 1 is an assembled, perspective view of a electrical connector of the present invention.
Figure 2:
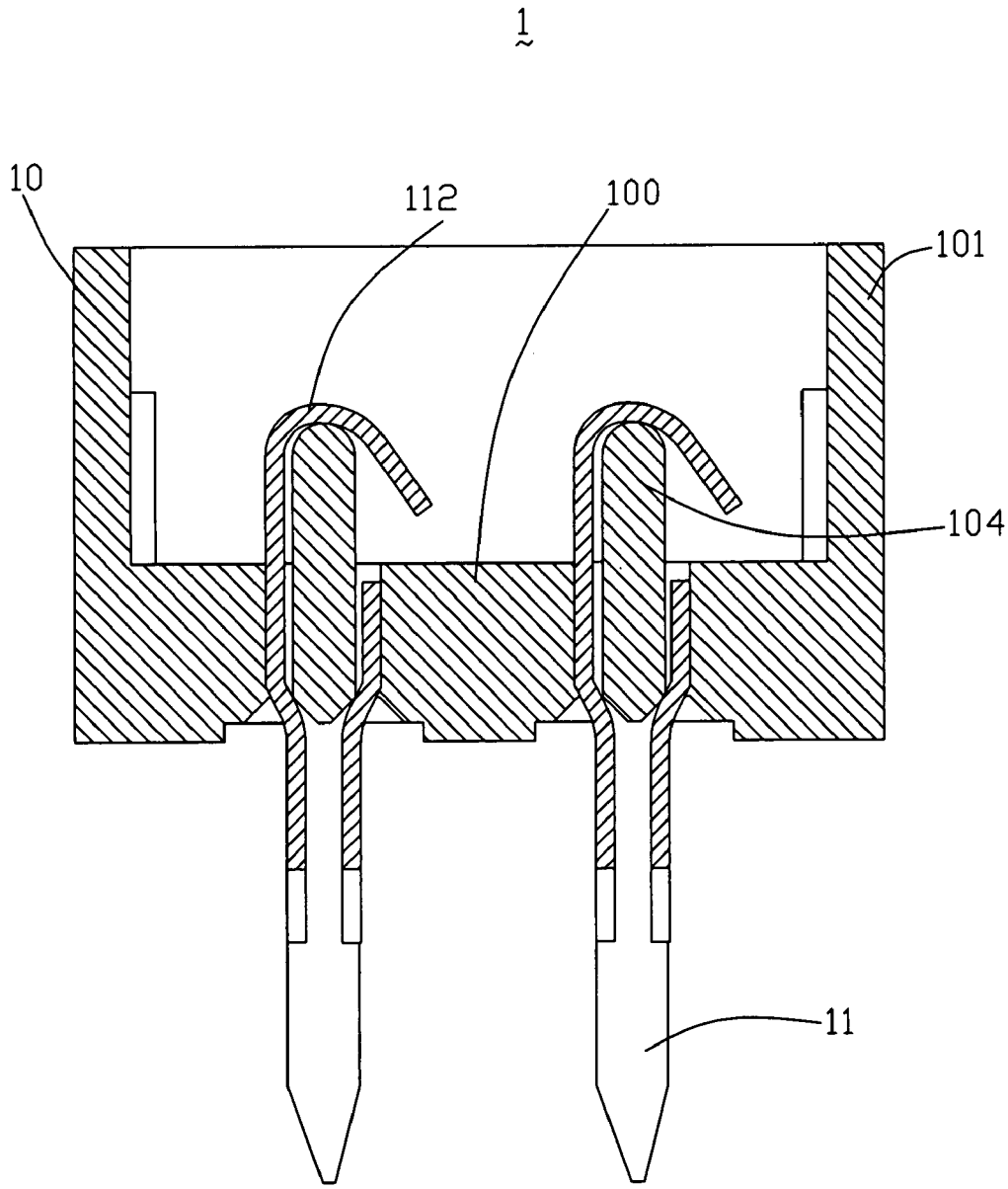
FIG. 2 is a section taken generally along line 2-2 of FIG. 1.

Referring to FIGS. 1 and 2, an electrical connector 1 which can be mounted on a printed circuit board (not shown) and can engage with a complementary mating electrical device (not shown) comprises an elongate dielectric housing 10 and a plurality of conductive contacts 11 retained in the dielectric housing 10.

Figure 3:
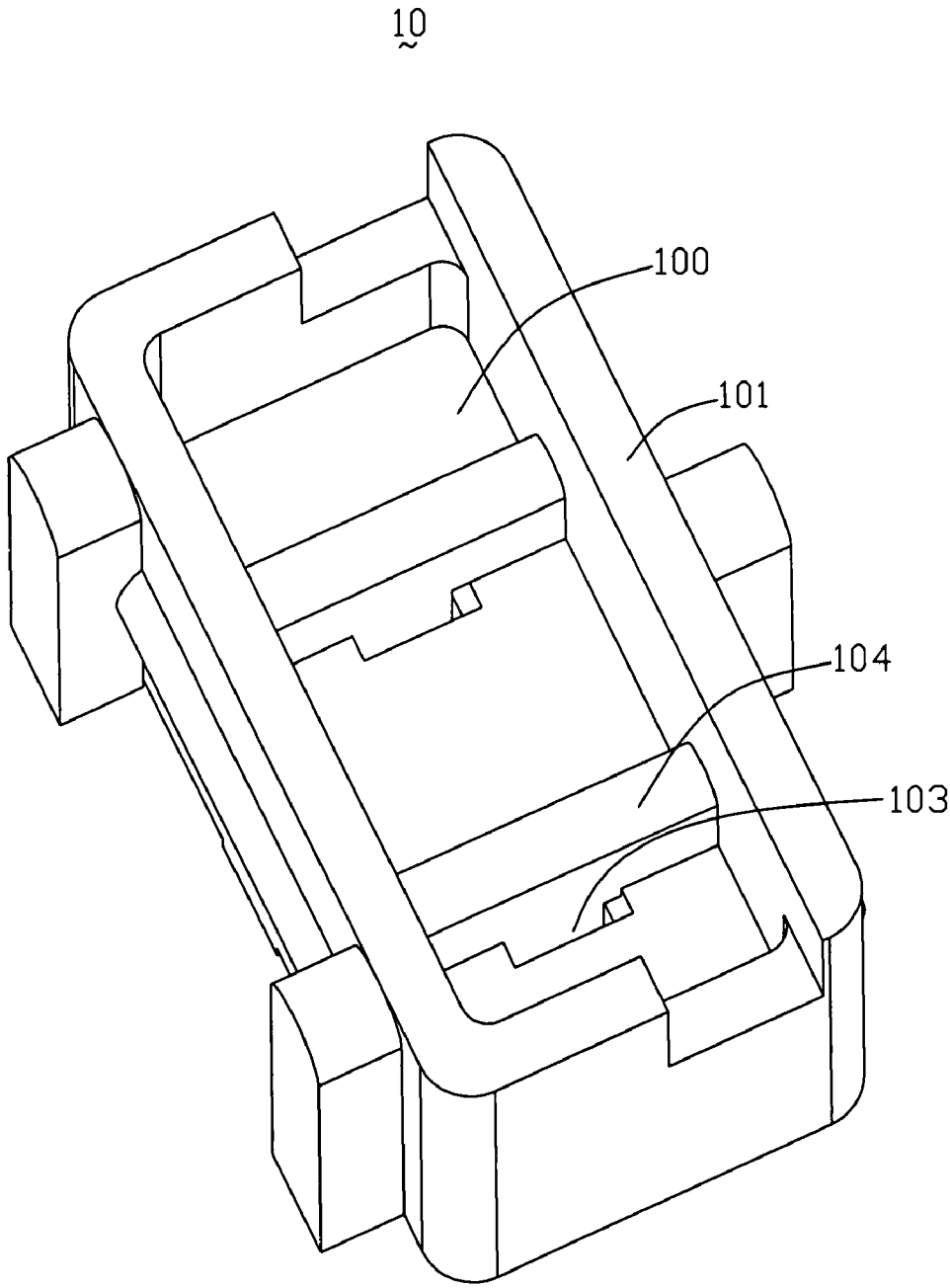
FIG. 3 is a perspective view of the housing of the electrical connector as viewed in FIG. 1.
Figure 4:
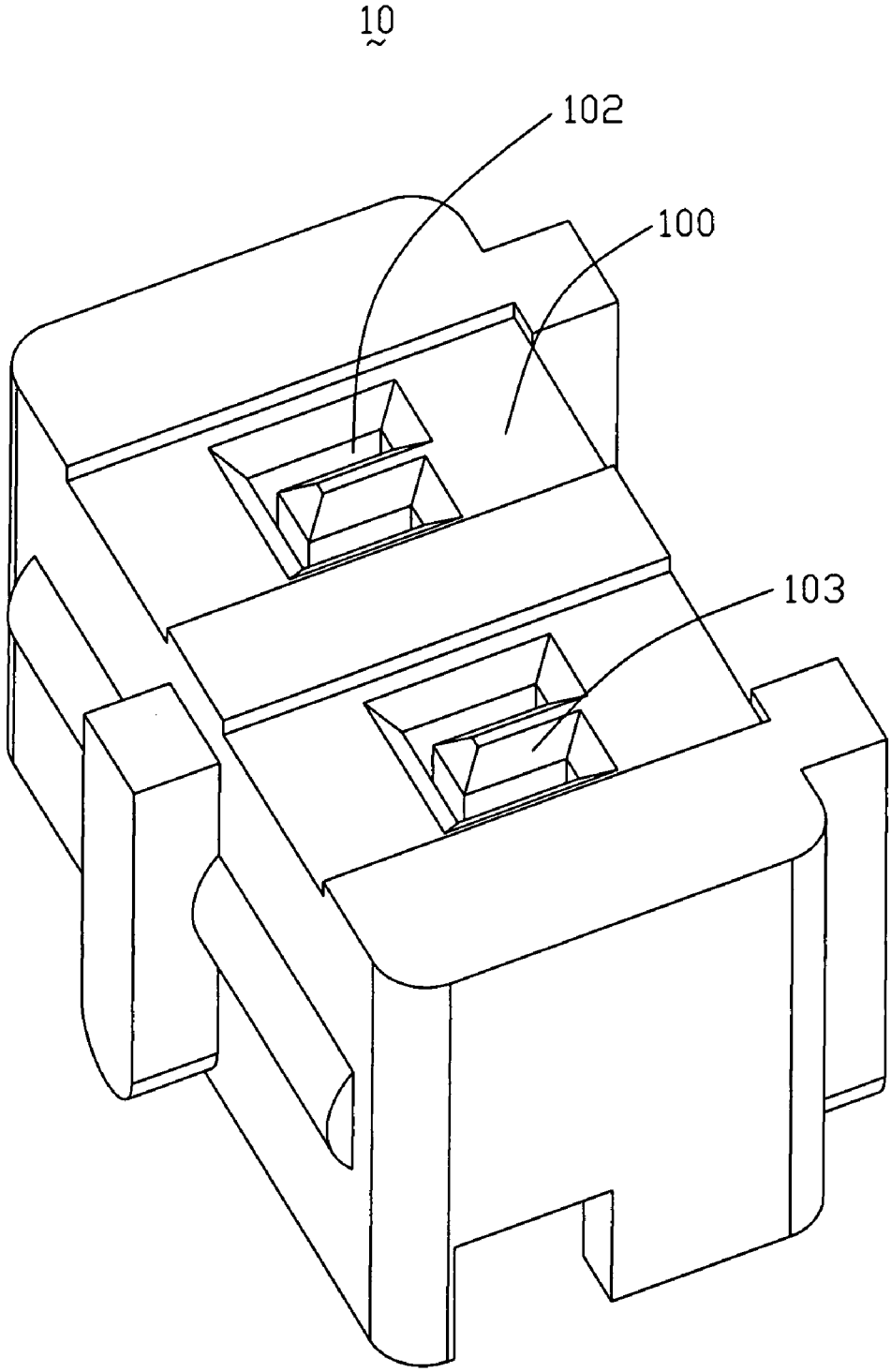
FIG. 4 is anther perspective view from anther angle of the housing of the electrical connector as viewed in FIG. 1.

Referring to FIGS. 3-4, the dielectric housing 10 comprises base portion 100 and four side walls 101 extending upward. The base portion 100 and side walls 101 form a receiving room for receiving a complementary mating electrical device. There is a plurality of contact passages 102 on the base portion 100, a guide portion 103 extending from each contact passage 102's inner wall, one end of the guide portion 103 extending to the locating pole 104, another end of the guide portion 103 extending not to outside of the contact passage 102, the width of the guide portion 103 is less than the width of the contact passage 102, and there is a space between it and the other surfaces of the contact passage 102.

The locating pole 104 is located inside said receiving room and right over the contact passage 102, it extends upward from the base portion 102 and connects with the two parallel side walls 101 of the housing 10. The width of the locating pole 104 is the same as the width of the guide portion 103, so the width is less than the width of the contact passage 102, too. The two sides of the locating pole 104 is positioned outside the contact passage 102, the top of the locating pole 104 is an arc like shape.

Figure 5:
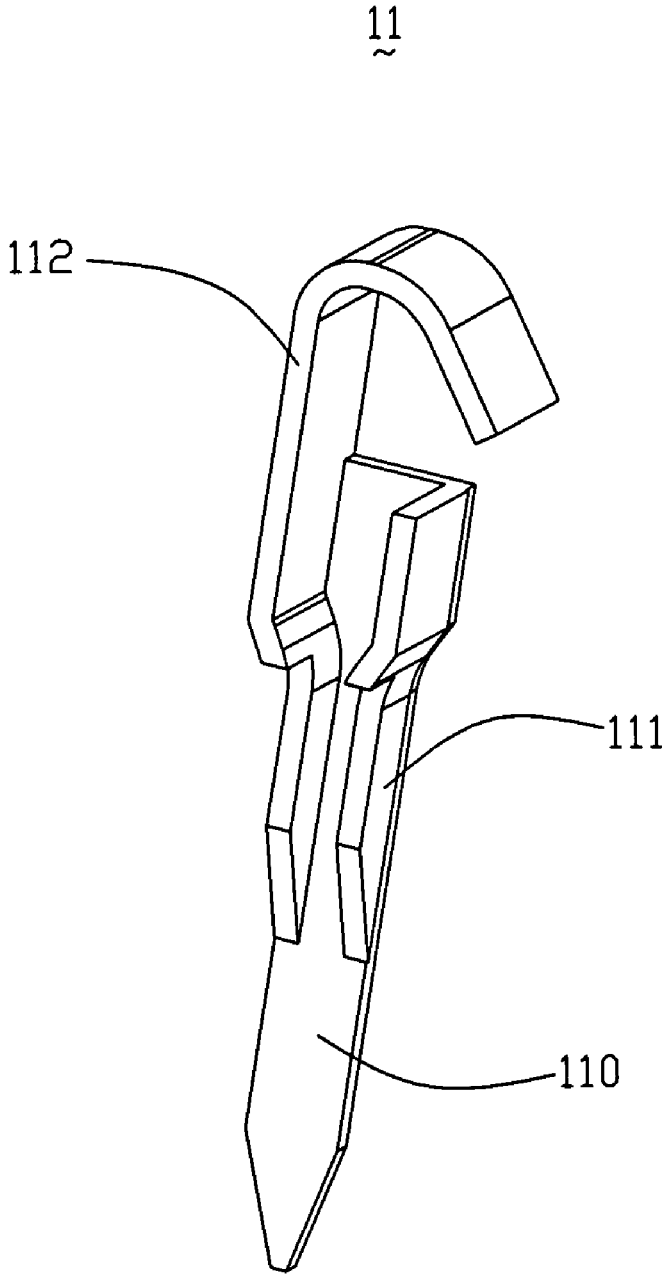
FIG. 5 is a perspective view of a contact of the electrical connector as viewed in FIG. 1.

Referring to FIGS. 1, 2, 5, each contact 11 of the electrical connector 1 comprises base portion 110, two arms 111 extending from the base portion 110, and contacting portion 112 extending from the base portion 110. The base portion 110 is plate like, one end of it is thin fit inserting into the hole of the printed circuit board. The two arms 111 perpendicularly extending from two opposite edges of the base portion 110. The contact portion 112 is extending upward from one of the arms 111 and is bent like an arc shape toward the side of the other arm 111, the arc shape free end is elastic and can elastically contact with the a complementary mating electronic device's contacting portion.

When the contacts 11 are received in the housing 10, the base portion 110 is received in the space between the guide portion 103 and the side wall 101, the guide portion 103 is located between the two arms 111, the contact portion 112 extending outside the contact passage 102 from the side of which the locating pole 104 and guide 103 is located and hanging on the top of the locating pole 104.

What is claimed is:

1. An electrical connector comprising:

a dielectric housing comprising a base portion comprising a plurality of contact passages;

a plurality of conductive contacts retained in said contact passages, a plurality of locating poles extending from the base portion, an end of said contact hanging on said locating pole, a plurality of side walls extending from said base portion, said base portion and said side walls form a receiving room;

wherein said locating pole is located right over the contact passage and two ends of which is connected with the side walls of housing.

2. The electrical connector of claim 1, wherein an end of said contact is bent like an arc shape.

3. The electrical connector of claim 1, wherein said locating pole is located right over the contact passage and the top of which is an arc like shape.

4. The electrical connector of claim 1, wherein a side wall of the contact passage form a guide portion extending upward, the width of the guide portion is less than the width of said passage and there is a space between the guide portion and the other side walls of the passage.

5. The electrical connector of claim 4, wherein said guide portion extends inside the passage and is connected with said locating pole.

6. The electrical connector of claim 1, wherein said contact comprises base portion extending vertically, two arms extending from two edges of the base portion, and contacting portion extending from the base portion.

7. The electrical connector of claim 6, wherein said contacting portion of said contact is extending upward from the top of an arm and is bent toward the other arm.

8. The electrical connector of claim 7, wherein said contacting portion is an arc like shape hanged on the locating pole.

9. An electrical connector comprising:

an insulative housing defining opposite first and second faces thereof, and a passageway therein between said first and second faces under an incomplete circumferential manner;

a contact inserted into the passageway from the first face toward the second face in a first direction;

a contacting section extending beyond the second face and further bent backward toward the second face so as to prevent the contact from being withdrawn in a second direction opposite to the first direction;

wherein the housing defines a pole having one side linked to the housing and other sides surrounded by the passageway, and the contacting section is seated upon a tip of said protrusion.

10. The electrical connector as claimed in claim 9, wherein said contact defines an offset section abutting against the housing around the first face for preventing excessive movement of the contact in said first direction.

11. The electrical connector as claimed in claim 9, wherein said pole extends away from the first face and further beyond the second face.

12. The electrical connector as claimed in claim 11, wherein said housing defines a plurality of side walls cooperating with the second face to form a receiving cavity into which both the contacting section and the protrusion extend.

13. The electrical connector as claimed in claim 9, wherein said passageway fully communicates with the first face while only partially communicates with the second face.

14. The electrical connector as claimed in claim 13, wherein the passageway communicates with the first face with a U-shaped cross-sectional configuration while with the second face with a slot-like cross-sectional configuration.

15. An electrical connector comprising:

an insulative housing defining therein a passageway between two opposite first and second faces, said passageway defines at least three sides at least partially surrounding a pole-like structure of the housing between the first face and the second face, said pole-like structure further extending beyond the second face; and a contact inserted into the passageway from the first face toward the second face in a first direction, and having a body portion at least partially surrounding the pole in the passageway with a portion abutting against a position of the housing around the first face for preventing excessive movement of the contact toward the second face;

wherein said position is located on the pole;

wherein said contact further include a contacting section extending beyond the second face and backwardly bent for seated upon an end of the pole for preventing the contact from being withdrawn from the passageway in a second direction opposite to the first direction.

* * * * *